US005507151A

United States Patent [19]

Ring et al.

[11] Patent Number: 5,507,151

[45] Date of Patent: Apr. 16, 1996

[54] NOISE REDUCTION IN SCREW COMPRESSOR-BASED REFRIGERATION SYSTEMS

[75] Inventors: H. Kenneth Ring, Houston; Martin J. Scholze, Hokah, both of Minn.

[73] Assignee: American Standard Inc., Piscataway, N.J.

[21] Appl. No.: 389,519

[22] Filed: Feb. 16, 1995

[51] Int. Cl.[6] ..... F25D 19/00; F04B 39/00

[52] U.S. Cl. ..... 62/115; 62/296; 181/206; 181/403; 417/312

[58] Field of Search ..... 62/296, 115; 417/312; 418/15; 181/202, 206, 403

[56] References Cited

U.S. PATENT DOCUMENTS

| | | | |
|---|---|---|---|
| 2,010,546 | 8/1935 | Kenney | 62/296 |
| 4,381,651 | 5/1983 | Kubo et al. | 62/296 |
| 4,549,857 | 10/1985 | Kropiwnicki et al. | 62/296 X |
| 4,923,374 | 5/1990 | Lundin et al. | 417/440 |
| 5,117,642 | 6/1992 | Nakanishi et al. | 181/206 X |
| 5,137,439 | 8/1992 | Lundin | 418/181 |
| 5,238,370 | 8/1993 | DiFlora | 417/312 |

*Primary Examiner*—William E. Tapolcal
*Attorney, Agent, or Firm*—William J. Beres; William O'Driscoll; Peter D. Ferguson

[57] ABSTRACT

Noise reduction in a screw compressor based refrigeration system is achieved by the use of multiple compressor discharge and/or suction lines. The lines are configured and/or fabricated from materials which reduce system noise which would otherwise be induced by vibration as well as the system noise associated with gas pulse energy in the discharge gas stream flowing from the compressor.

21 Claims, 2 Drawing Sheets

NOISE REDUCTION IN SCREW COMPRESSOR-BASED REFRIGERATION SYSTEMS

BACKGROUND OF THE INVENTION

The present invention relates to refrigeration systems. More particularly, the present invention relates to a refrigeration system in which a screw compressor is employed and to the reduction of noise created by the operation of the screw compressor in the system.

Screw compressors, by their nature, create a relatively large amount of noise as a result of compressor vibration and in the form of gas pulse energy transmitted from the compressor to system components both upstream and downstream thereof. The beneficial use of the pulse energy in the discharge gas stream of a screw compressor has, in fact, been suggested to acoustically clean the walls of closed spaces, such as in the process industry, or to cause the mixing of two different gaseous media into a single homogenized gas. U.S. Pat. No. 4,923,374 is pertinent in that regard.

Svenska Rotor Maskinet AB, the owner of the '374 patent, has likewise recognized the need, in other applications, to damp the sound and noise of screw rotor machines and has conducted work in that regard as is evidenced by its U.S. Pat. No. 5,137,439. As is set forth in column 1, lines 12–14 of the '439 patent, the difficulty in damping noise in screw rotor machine is "mainly because both the inlet line and the outline line, and particularly the latter, conduct low-frequency noise of large amplitudes in the machine".

Svenska's solution to that problem in the '439 patent is to incorporate a so-called De Laval nozzle as a sound silencing device in the vicinity of the inlet and/or outlet port of a screw compressor. As is well known, the capacity of a screw compressor can relatively easily and advantageously modulated. The De Laval nozzle of the '439 patent includes a moveable valve body, biased by a substantially constant spring force, that functions to maintain a constant pressure drop across the nozzle to permit it to maintain the velocity of the gas flowing through it immediately beneath the speed of sound irrespective of the capacity at which the machine operates.

As is noted in the '439 patent, movement of the valve body within the nozzle must be damped to achieve only slow changes in gas flow through the nozzle in order to maintain the nozzle's effectiveness. Absent the use the sound silencing apparatus of the '439 patent, it is noted that a large volume silencer would be required in order to achieve effective sound damping, particularly with respect to the low-frequency impact (pulse) waves generated by the operation of a screw compressor. What is not recognized is that the nozzle apparatus suggested in the '439 patent disadvantageously requires the use of moving parts which are subject to breakdown and wear and which add to the manufacturing cost of the system in which a screw compressor is employed.

The need continues to exist for better, less expensive and mechanically more simple apparatus and mechanisms by which to achieve noise reduction in systems in which screw compressors are employed and, in particular, in screw compressor-based refrigeration systems used in the comfort conditioning of office buildings where the compressor component of the system is most often disposed in relatively small and enclosed equipment rooms or spaces.

SUMMARY OF THE INVENTION

It is an object of the present invention to reduce the noise generated by the operation of a screw compressor in a screw compressor-based refrigeration system.

It is a further object of the present invention to reduce the noise generated by a screw compressor without employing additional, discrete and/or dedicated sound silencing apparatus.

It is a further object of the present invention to achieve sound silencing in a screw compressor-based refrigeration system without the use of moving parts.

It is still another object of the present invention to eliminate the need for large volume, heavy and expensive sound silencers in screw compressor-based refrigeration systems.

Finally, it is an object of the present invention to reduce the noise resulting from vibration and gas pulse energy transmitted from a screw compressor to other parts of a refrigeration system in which the compressor is employed by reducing the mass/thickness of the material through which vibration would otherwise be conducted and through the use of phase shifting to achieve the self-cancellation of the energy which leaves the compressor in the form of gas pulses.

These and other objects of the present invention, which will be appreciated when the attached drawing figures and the following Description of the Preferred Embodiment are considered, are achieved by the use of multiple discharge and/or suction lines through which compressed gas is discharged from or suction gas is received into a screw compressor.

The multiple suction and/or discharge lines present smaller cross sectional flow paths, have smaller wall thicknesses and are less stiff than would a comparable single suction or discharge line capable of flowing a comparable volume of gas to or from a screw compressor at an equivalent mass flow rate. The multiple lines therefore transmit less vibration energy than would single suction or discharge lines of equal flow capacity. Further, by the use of multiple discharge lines, pressure pulses created during the gas compression and discharge process can be self-cancelled by recombining the individual flow streams at a downstream location where the gas pulses in the individual flow streams are out of phase. This significantly reduces the gas pulse energy transmitted to system components downstream of the recombination location and the noise that would otherwise be created thereby.

By the use of multiple suction and/or discharge lines, significant noise reduction in screw compressor-based refrigeration systems is achieved without the use of moving parts, without the use of large volume or discrete sound silencing apparatus and at essentially no more expense or manufacturing effort than would be the case if single suction and/or discharges lines were employed,

DESCRIPTION OF THE DRAWING FIGURES

FIG. 1 illustrates a refrigeration system of the present invention.

FIGS. 2*a*, 2*b* and 2*c* illustrate a coupling by which the multiple suction and/or discharge lines of the present invention can be connected for flow to components in the refrigeration system of FIG. 1.

DESCRIPTION OF THE PREFERRED EMBODIMENT

Figure 1:
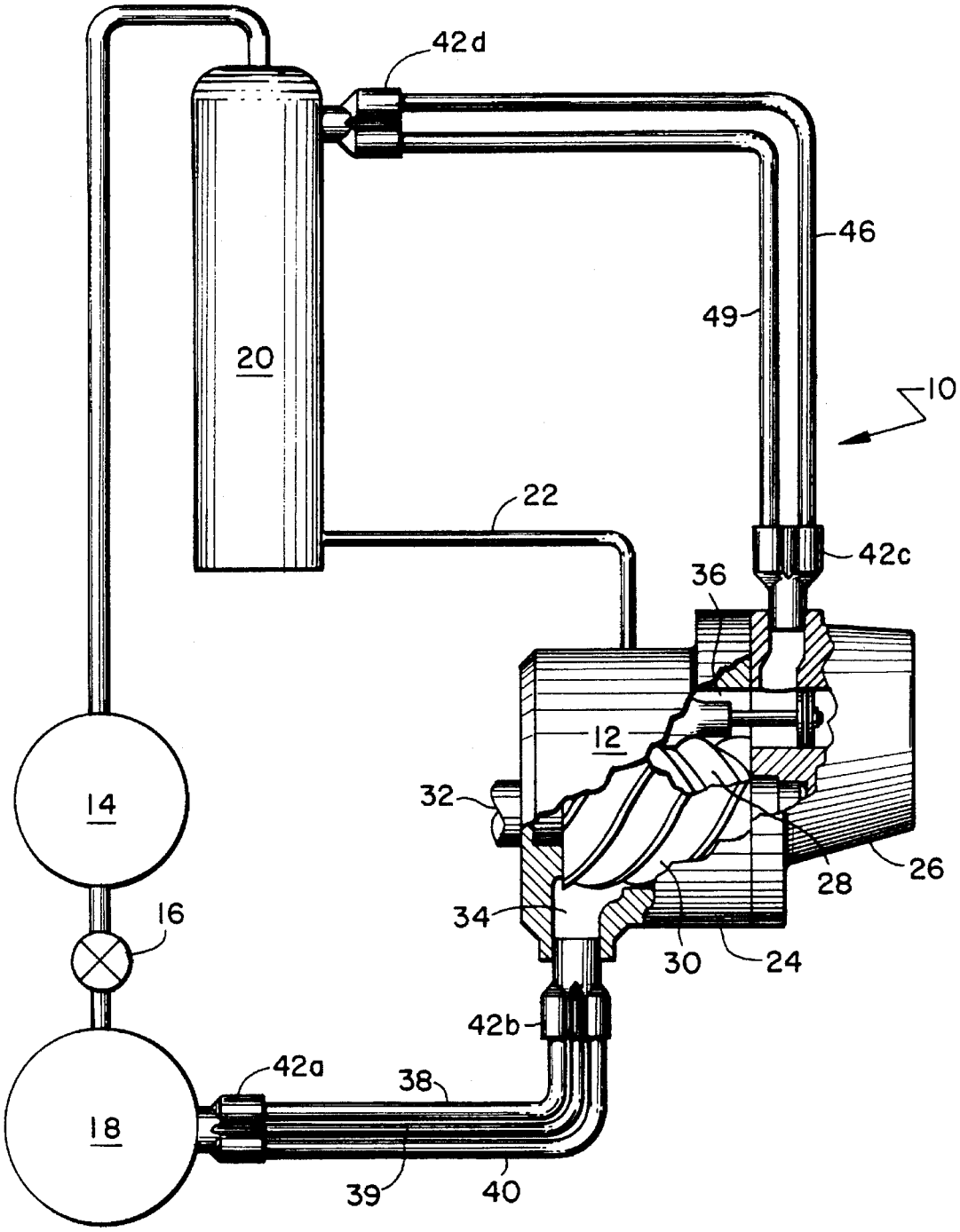

In the refrigeration system illustrated of FIG. 1, refrigeration system 10 is comprised of a screw compressor 12, a condenser 14, a refrigerant metering device 16 and an evaporator 18 all of which are serially connected to permit the flow of refrigerant therethrough. An oil separator 20 is disposed between condenser 14 and compressor 12 to receive the refrigerant gas flow stream discharged from the compressor which will have a significant amount of oil entrained in it. Oil separated from the refrigerant gas in oil separator 20 is returned through line 22 to compressor 12 for re-use while the discharge gas is directed to the condenser.

Compressor 12 is comprised of a rotor housing 24 and bearing housing 26. Rotor housing 24 defines a working chamber in which male screw rotor 28 and female screw rotor 30 are meshingly and rotatably disposed. One of the two screw rotors is driven by a prime mover, such as an electric motor (not illustrated), through drive shaft 32. The driven rotor, in turn, drives the other rotor as a result of their intermeshing relationship.

Refrigerant gas is directed into suction area 34 of compressor 12 and is drawn into a chevron shaped compression pocket defined by the screw rotors and the wall of the working chamber. As a result of the rotation of the rotor pair, the compression pocket is reduced in volume, which increases the pressure of the gas therein, and is circumferentially displaced to the discharge end of the compressor where it opens to discharge passage 36.

Connecting into evaporator 18 and suction area 34 of compressor 12 are suction lines 38, 39 and 40 which collectively form the suction line for the compressor. The flow of refrigerant gas at relatively low pressure out of the evaporator 18 is through coupling 42*a* which divides, at its downstream end, into multiple flow paths. Suction lines 38 and 40 are sealingly connected into the flow paths defined at the downstream end of coupling 42*a*.

Second coupling 42*b* is similar or identical to coupling 42*a* and connects suction lines 38, and 40 to suction area 34 of compressor 12. In the case of coupling 42*b*, the individual flow paths through which suction gas travels to compressor 12 are recombined so that a single stream of suction gas is delivered into suction area 34 of the compressor.

Figure 2A:
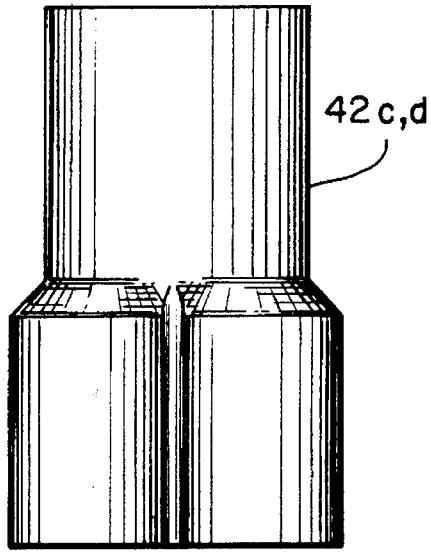
Figure 2B:
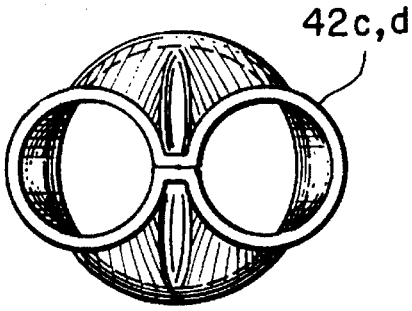
Figure 2C:
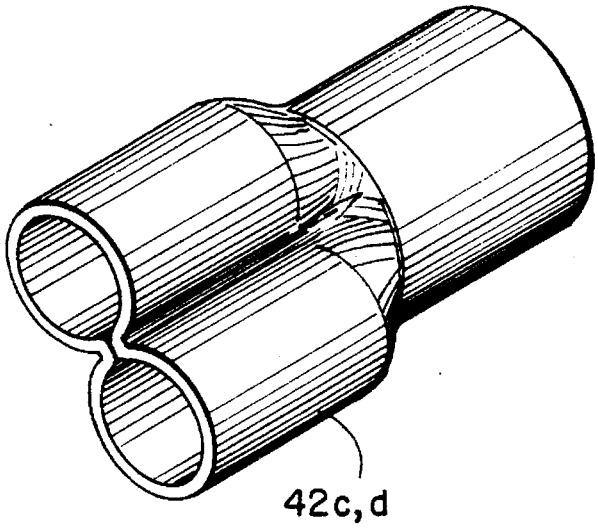

Referring additionally now to FIG. 2, discharge coupling 42*c* is connected to compressor 12 and is in flow communication with discharge passage 36. Coupling 42*c* diverges at its downstream end into at least two flow paths. Discharge lines 44 and 46 are sealingly connected into the multiple flow paths created at the downstream end of coupling 42*c*.

A coupling 42*d*, similar or identical to coupling 42*c*, connects discharge lines 44 and 46 to oil separator 20. The multiple flow paths at the upstream end of coupling 42*d* are recombined in coupling 42*d* so that a single flow path into oil separator 20 out of the multiple discharge lines is created.

In order to convey the necessary amount of gas to the compressor, more suction than discharge lines will typically be employed due to the density differences between suction and discharge gas. Therefore, couplings 42*a* and 42*b* will differ from discharge couplings 42*c* and 42*d* primarily in the number of lines connecting thereinto. Once again, however, couplings 42*c* and 42*d*, which as illustrated accommodate two discharge lines, are illustrative only of and it is contemplated that suction and discharge lines of any number more than one each fall within the scope of this invention with the typical circumstance being that the number of suction lines exceeds the number of discharge lines.

With respect to suction lines 38, 39 and 40 and couplings 42*a* and 42*b*, the use of the multiple suction lines, which are individually of a smaller cross-section and thinner wall thickness than would be a single suction line used for the same purpose, reduces the vibration energy transmitted upstream from compressor 12 to the evaporator component of system 10. Further, the vibration of the individual suction lines 38, 39 and 40 themselves and the noise associated directly therewith is appreciably less, as a result of their being relatively less stiff and of less mass, than the noise which would be generated by the vibration of a single, larger and more stiff suction line of comparable gas carrying capacity. The noise created by the compressor which is carried upstream thereof is therefore reduced at essentially no expense and without affecting the efficiency of the compressor or system in which it is employed.

By the use of multiple discharge lines 44 and 46, the same result is achieved in the same way downstream of compressor 12 with respect to vibration induced noise created by the operation of the compressor. More significantly, however, by the use of multiple discharge lines and by the downstream recombination of the gas flow paths therethrough, a significant reduction in the system noise associated with gas pulse energy is achieved.

Recombination of the individual flow streams results in the self-cancellation of the gas pulse energy in the individual flow streams by their mutually destructive interaction in the flow recombination process. By the use of discharge gas flow paths of different lengths an even greater reduction of such energy is achieved which is attributable to the phase relationships of the gas pulse energy at the point of delivery to the recombination location.

It will be appreciated that although three suction and two discharge lines are illustrated in FIG. 1, optimal noise reduction or system parameters in a particular case may suggest the use of more than two lines in the suction any or more than three lines in the discharge locations. As was earlier suggested, however, in particular applications, the use of only two suction lines with two or more discharge lines may be appropriate. It must further be appreciated that the selective use of multiple lines only at the suction or discharge ends of the compressor is contemplated where appropriate.

It will still further be appreciated that the recombination of the Multiple discharge gas flow streams need not necessarily be accomplished by the use of couplings such as those illustrated. For instance, direct connection of the individual multiple suction and/or discharge lines to the evaporator, compressor or oil separator, as the case may be, without the use of a discrete coupling element is contemplated. Further, the use of "configured" multiple suction or discharge lines such as ones having an integral loop or coil or which are otherwise made flexible such as through the use of a corrugated conduit material are contemplated as is the use of non-metallic conduit or couplings and the use of a combination of lines of differing cross-sectional flow area.

What is claimed is:

1. A refrigeration system comprising:

a condenser;

a metering device connected to said condenser;

an evaporator connected to said metering device;

a screw compressor, said screw compressor defining a suction area and a discharge passage; and multiple flow lines connecting at least one of said suction area and said discharge passage of said compressor to at least one of said condenser and said evaporator.

2. The refrigeration system according to claim 1 wherein said multiple flow lines connect to said discharge passage of said compressor.

3. The refrigeration system according to claim 2 wherein at least two of the flow paths defined by said multiple flow lines connected to said discharge passage of said compressor are of different lengths.

4. The refrigeration system according to claim 3 further comprising a coupling connecting said discharge passage of said compressor to said multiple flow lines through a single flow path which diverges into multiple flow paths and wherein the combined cross-sectional areas of said at least two discharge flow paths are comparable to the cross-sectional area of a single discharge flow path capable of flowing an equal volume gas at discharge pressure from said compressor.

5. The refrigeration system according to claim 4 further comprising a second coupling connected to said multiple flow lines at the downstream end thereof, the multiple flow paths defined by said multiple flow lines converging in said second coupling into a single flow path.

6. The refrigeration system according to claim 5 further comprising an oil separator connected for flow to said condenser said second coupling being connected for flow at its downstream end with said oil separator.

7. The refrigeration system according to claim 3 further comprising an oil separator connected for flow to said condenser, said multiple flow lines connected said discharge passage of said compressor being connected for flow to said oil separator.

8. The refrigeration system according to claim 7 further comprising a coupling defining a flow path between said discharge passage of said compressor and said multiple flow lines, said coupling defining a single flow path at its upstream end which diverges into multiple flow paths connected for flow to said multiple flow lines.

9. The refrigeration system according to claim 8 further comprising a coupling connecting said multiple flow lines and the flow paths defined thereby to said oil separator, said coupling causing the flow paths defined by said multiple flow lines to converge into a single flow path in communication with said oil separator.

10. The refrigeration system according to claim 1 wherein said suction area of said compressor is connected to said evaporator by multiple flow lines.

11. The refrigeration system according to claim 10 further comprising a coupling disposed intermediate said suction area of said compressor and said multiple flow lines which connect said evaporator to said suction area of said compressor, said coupling causing the flow paths defined by said multiple flow lines to converge into a single flow path.

12. The refrigeration system according to claim 11 further comprising a coupling disposed intermediate said evaporator and said multiple flow lines which connect said evaporator to said suction area of said compressor, said coupling causing the flow of gas out of said evaporator to diverge into the flow paths defined by said multiple flow lines.

13. The refrigeration system according to claim 1 wherein said multiple flow lines connect into both said suction area and said discharge passage of said compressor.

14. The refrigeration system according to claim 13 wherein at least two of the flow paths defined by said multiple flow lines connected to said discharge passage of said compressor are of different lengths.

15. The refrigeration system according to claim 14 further comprising an oil separator connected for flow to said condenser, the multiple flow lines connected to said discharge passage of said compressor connecting said discharge passage of said compressor for flow with said oil separator.

16. The refrigeration system according to claim 15 further comprising a first coupling disposed between said evaporator and said multiple lines connecting said evaporator to said compressor, said first coupling causing the flow of gas out of said evaporator to diverge as it enters said multiple flow lines, a second coupling disposed between said multiple flow lines connecting said evaporator to said compressor, said second coupling causing the flow of gas out of said multiple flow lines connecting said evaporator to said compressor to converge into a single flow path, a third coupling disposed between said discharge passage of said compressor and said multiple flow lines connecting said compressor and said oil separator, said third coupling causing the flow of gas out of said discharge passage to diverge prior to entering said multiple flow lines connecting said discharge passage of said compressor to said oil separator and a fourth coupling disposed between said multiple flow lines connecting said discharge passage of said compressor to said oil separator, said fourth coupling causing the flow of gas out of said multiple flow lines connecting said discharge passage of said compressor to said oil separator to converge into a single flow path.

17. A method for reducing noise in screw compressor-based refrigeration systems comprising the steps of:

compressing refrigerant gas from a suction to a discharge pressure in said compressor;

flowing gas at said discharge pressure from said compressor through at least two discharge flow paths; and recombining the flow of gas passing through said multiple flow paths at a location where the gas pulse energy in the gas flowing through the individual ones of the multiple flow paths is out of phase so that the recombination thereof causes a cancellation of such energy and a reduction of the noise generated by said system.

18. The method according to claim 17 wherein the combined cross-sectional areas of said at least two discharge flow paths are capable of flowing a volume of gas at discharge pressure from said compressor equal to that volume which would be flowed through a single discharge flow path having a cross-sectional area comparable to said combined cross-sectional areas.

19. The method according to claim 17 wherein said at least two of said at least two discharge flow paths are of different lengths and further comprising the step of coupling said compressor to said at least two discharge flow paths in a manner which causes the flow of gas flowed from said compressor to diverge prior to entering said at least two discharge flow paths.

20. The method according to claim 19 wherein said recombining step includes the step of coupling said at least two flow paths to a downstream refrigeration system component in a manner which causes the causes the flow of gas to said downstream system component to converge prior to its delivery to said downstream system component.

21. The method according to claim 18 comprising the further step of flowing gas to said compressor for compression therein through at least two suction flow paths, the combined cross-sectional areas of said at least two suction flow paths being no greater than the cross-sectional area of a single suction flow path capable of flowing an equal volume of gas at suction pressure to said compressor at an equivalent mass flow rate.

* * * * *